US009072349B1

(12) United States Patent
Thompson et al.

(10) Patent No.: US 9,072,349 B1
(45) Date of Patent: Jul. 7, 2015

(54) MISTING UMBRELLA

(71) Applicants: Robert Thompson, Gap, PA (US); Linda Thompson, Gap, PA (US)

(72) Inventors: Robert Thompson, Gap, PA (US); Linda Thompson, Gap, PA (US)

( * ) Notice: Subject to any disclaimer, the term of this patent is extended or adjusted under 35 U.S.C. 154(b) by 0 days.

(21) Appl. No.: 14/218,134

(22) Filed: Mar. 18, 2014

(51) Int. Cl.
*A45B 3/00* (2006.01)
*B05B 15/06* (2006.01)
*A45B 25/00* (2006.01)

(52) U.S. Cl.
CPC . *A45B 25/00* (2013.01); *A45B 3/00* (2013.01); *B05B 15/06* (2013.01); *A45B 2200/1045* (2013.01)

(58) Field of Classification Search
CPC .. A45B 23/00; A45B 3/00; A45B 2200/1009; A45B 2200/1081; A45B 2200/1045; B05B 15/00; B05B 15/06; B05B 11/30
USPC ..... 135/98, 96, 16, 15.1, 902, 83, 25.4; 239/269, 280; 119/651, 659, 665
See application file for complete search history.

(56) References Cited

U.S. PATENT DOCUMENTS 2,941,695 A * 6/1960 Rich ..... 222/132
5,143,107 A * 9/1992 Kelley ..... 135/16
5,207,238 A * 5/1993 Rivera et al. ..... 135/16
D412,199 S 7/1999 Louis
5,979,793 A * 11/1999 Louis ..... 239/128
6,612,713 B1 9/2003 Kuelbs
6,682,000 B1 1/2004 Apple
6,848,629 B2 * 2/2005 Palmer et al. ..... 239/17
6,886,759 B1 5/2005 Okronick
7,412,984 B1 8/2008 Spencer
7,497,225 B1 * 3/2009 Klein et al. ..... 135/16
7,513,126 B2 * 4/2009 Boland ..... 62/310
2002/0078985 A1 * 6/2002 Farr ..... 135/16
2004/0129303 A1 * 7/2004 Dong ..... 135/16
2005/0161066 A1 7/2005 Ma
2005/0172987 A1 8/2005 Byrnes
2008/0048051 A1 * 2/2008 Chang ..... 239/289
2009/0283121 A1 * 11/2009 Chu ..... 135/16
2013/0213446 A1 * 8/2013 Rao ..... 135/16

* cited by examiner

*Primary Examiner* — Winnie Yip
(74) *Attorney, Agent, or Firm* — Kyle A. Fletcher, Esq.

(57) ABSTRACT

The fluid misting assembly includes a handle coupled to an umbrella. The handle may be gripped by a user. A reservoir is coupled to the handle. The reservoir contains a fluid. A pump is coupled to the handle. The pump is operationally coupled to the reservoir. The pump urges the fluid outwardly from the reservoir. A shaft of the umbrella has a fluid aperture extending therethrough. A tube is coupled to the umbrella. The tube is operationally coupled to the pump. The pump urges the fluid through the tube. The tube is operationally coupled to the fluid aperture extending through the shaft of the umbrella. The fluid is sprayed outwardly from the shaft onto the user.

16 Claims, 5 Drawing Sheets

MISTING UMBRELLA

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of umbrellas, more specifically, misting umbrellas.

SUMMARY OF THE INVENTION

An embodiment of the disclosure meets the needs presented above by generally comprising a handle coupled to an umbrella. The handle may be gripped by a user. A reservoir is coupled to the handle. The reservoir contains a fluid. A pump is coupled to the handle. The pump is operationally coupled to the reservoir. The pump urges the fluid outwardly from the reservoir. A shaft of the umbrella has a fluid aperture extending therethrough. A tube is coupled to the umbrella. The tube is operationally coupled to the pump. The pump urges the fluid through the tube. The tube is operationally coupled to the fluid aperture extending through the shaft of the umbrella.

An object of the invention is to provide a device that is misting umbrella.

These together with additional objects, features and advantages of the misting umbrella will be readily apparent to those of ordinary skill in the art upon reading the following detailed description of presently preferred, but nonetheless illustrative, embodiments of the misting umbrella when taken in conjunction with the accompanying drawings.

In this respect, before explaining the current embodiments of the misting umbrella in detail, it is to be understood that the misting umbrella is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the misting umbrella.

It is therefore important that the claims be regarded as including such equivalent construction insofar as they do not depart from the spirit and scope of the misting umbrella. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
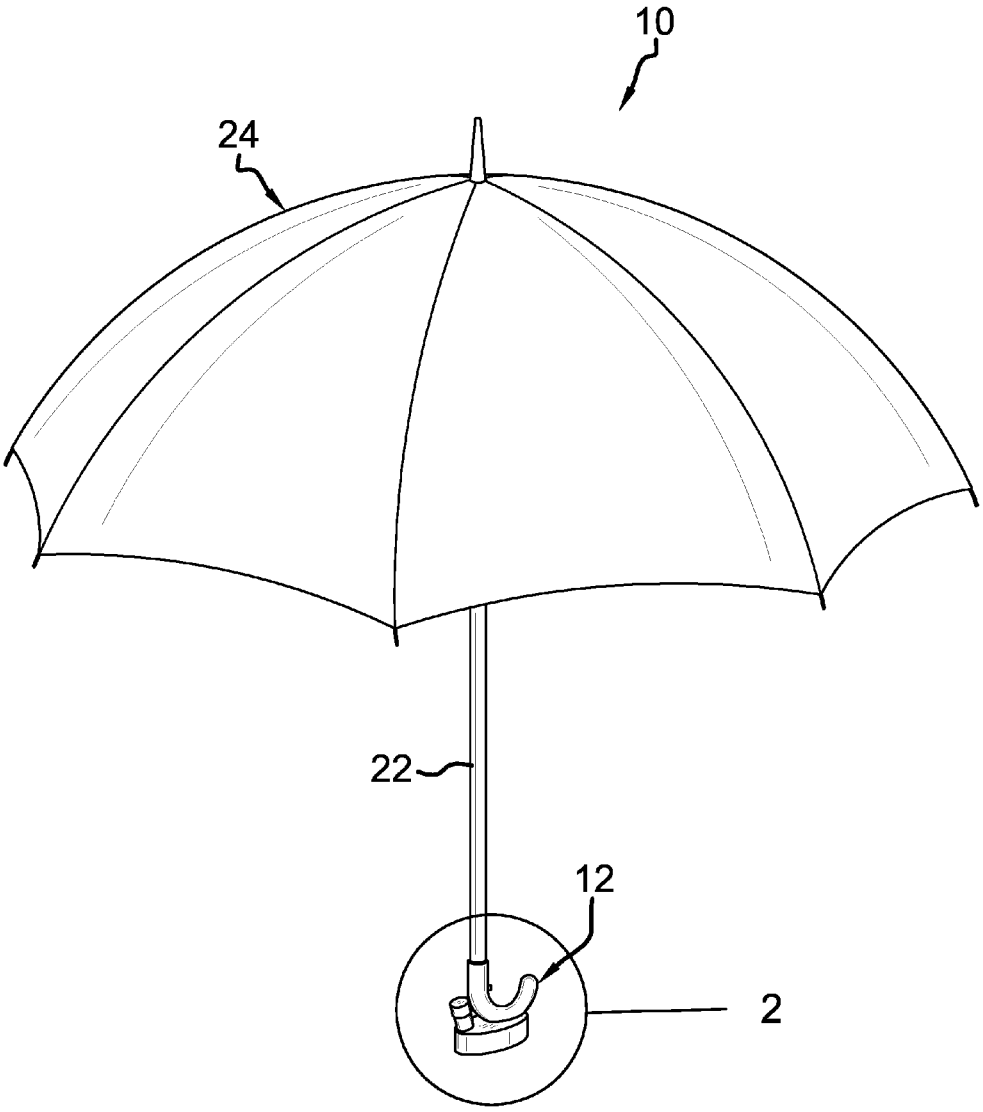
FIG. 1 is a perspective view of a fluid misting assembly according to an embodiment of the disclosure.
Figure 2:
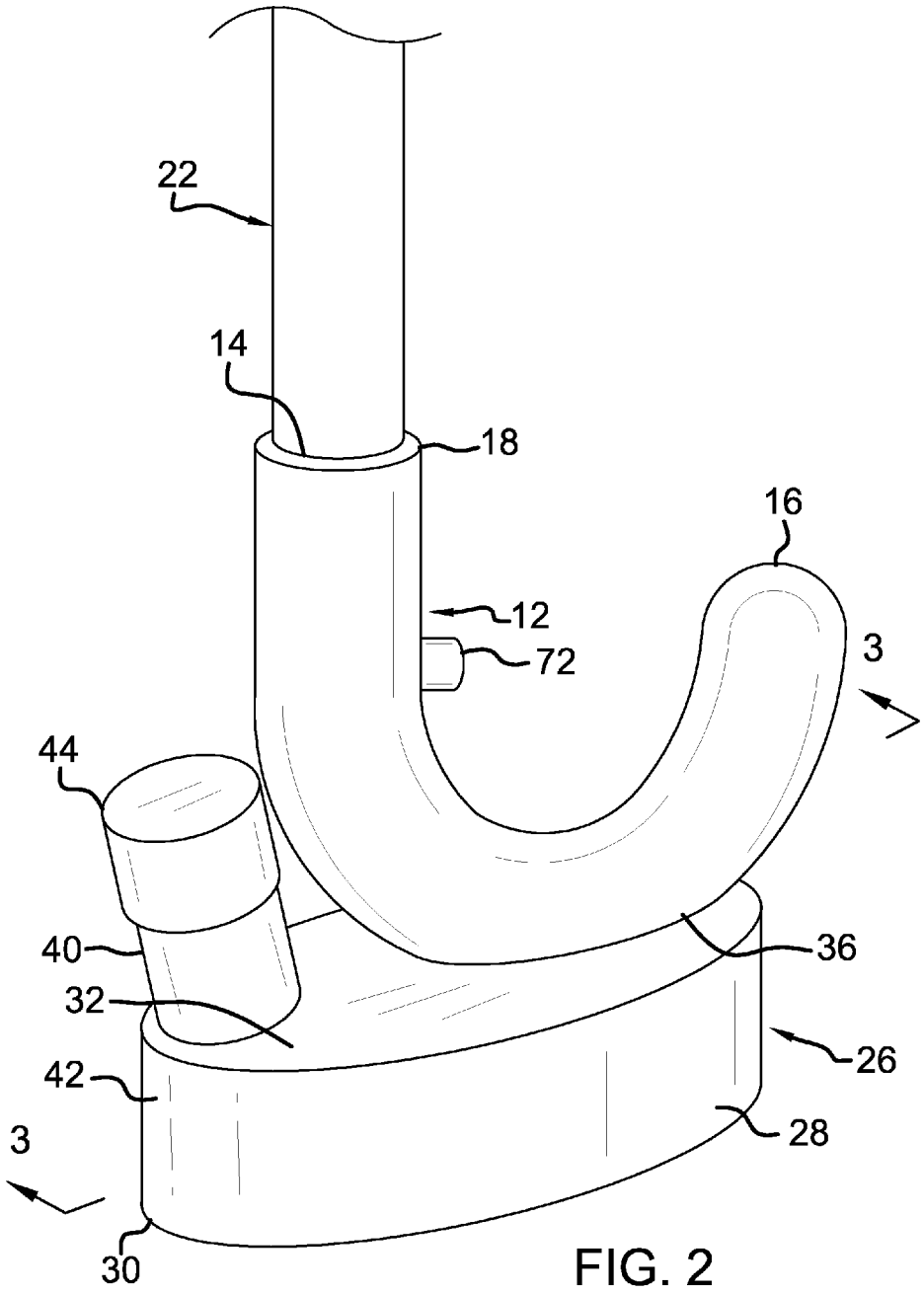
FIG. 2 is a front perspective view of an embodiment of the disclosure.
Figure 3:
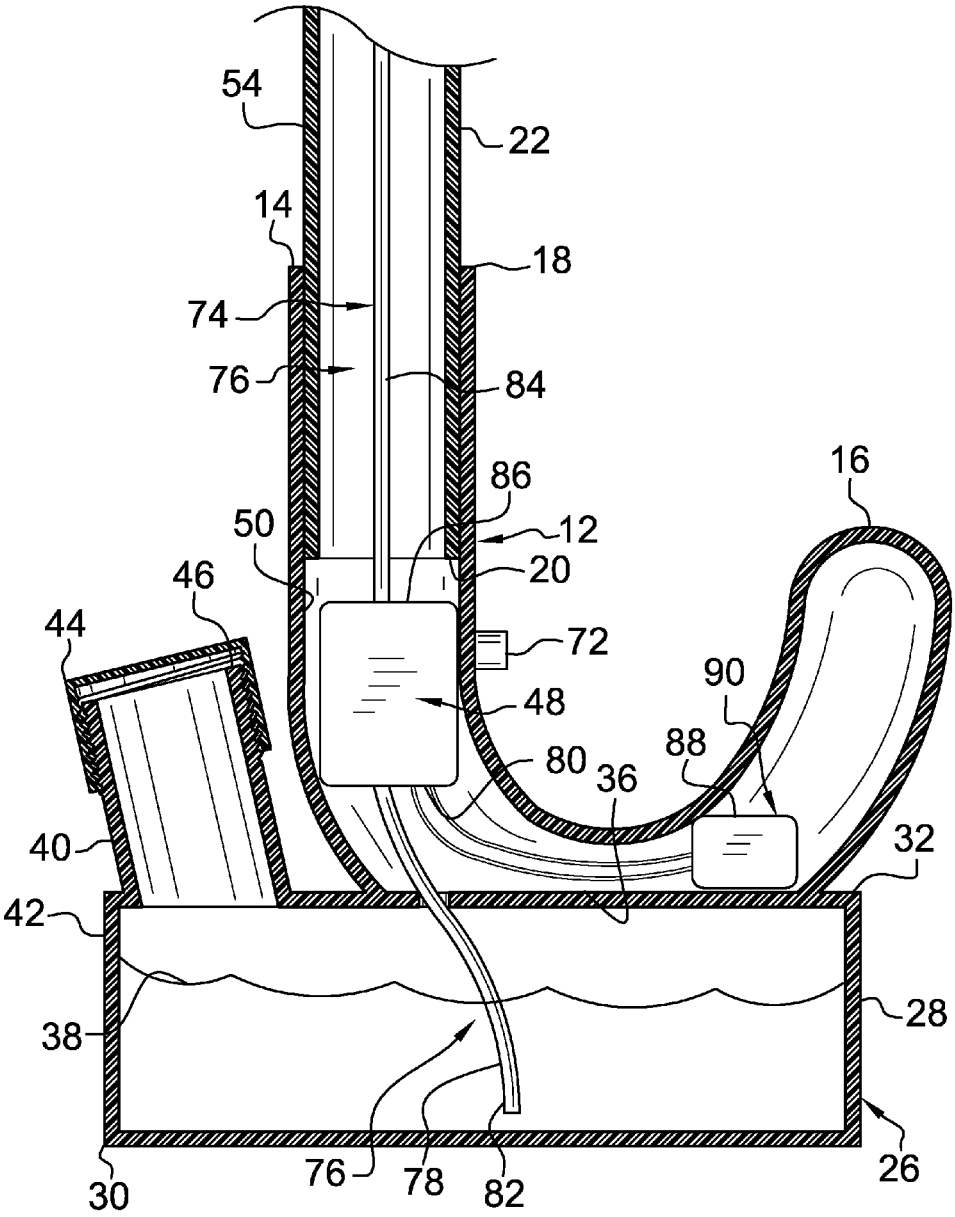
FIG. 3 is a cross sectional view taken along line 3-3 of FIG. 2 of an embodiment of the disclosure.
Figure 4:
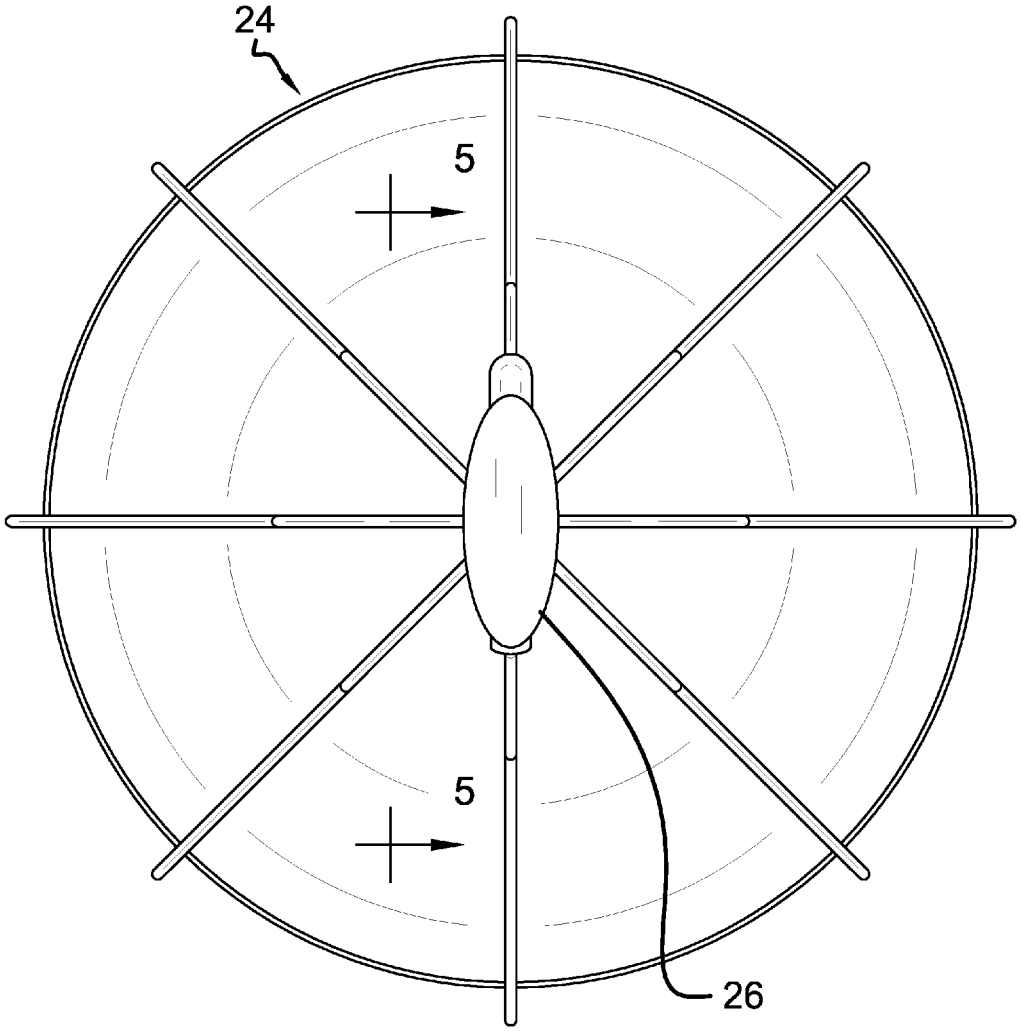
FIG. 4 is a bottom view of an embodiment of the disclosure.
Figure 5:
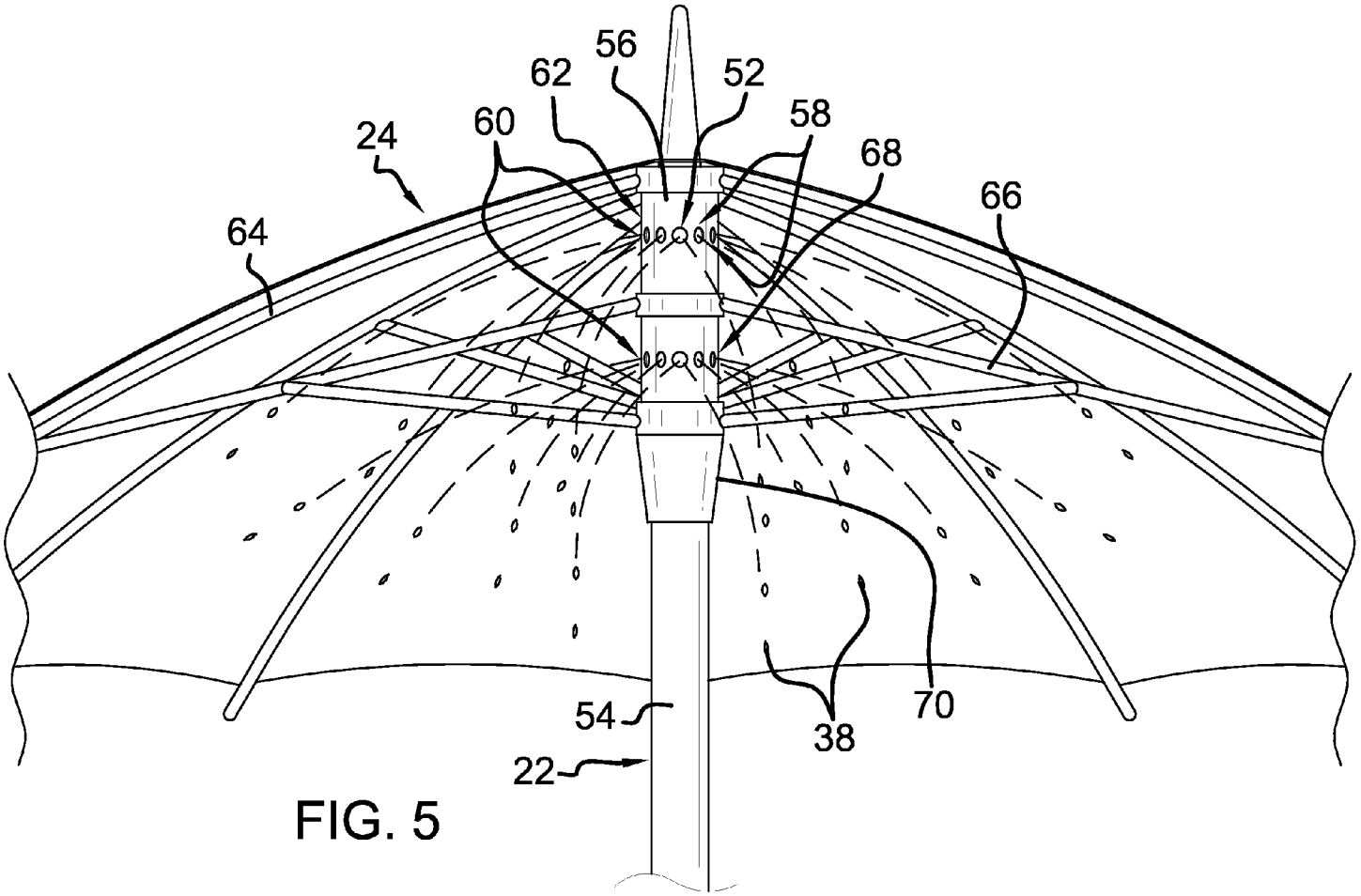
FIG. 5 is an in-use view of an embodiment of the disclosure.

As best illustrated in FIGS. 1 through 5, the fluid misting assembly 10 generally comprises a handle 12 that has a first end 14 and a second end 16. The first end 14 of the handle 12 is open and the handle 12 is substantially hollow. An outer wall 18 of the handle 12 is curved between the first 14 and second 16 ends of the handle 12 so the handle 12 has a J-shape. The first end 14 of the handle 12 insertably receives a bottom end 20 of a shaft 22 of an umbrella 24. The handle 12 may be gripped by a user.

A reservoir 26 is provided. An external side 28 of an outer wall 30 of the reservoir 26 extends between a top side 32 and a bottom side 34 of the outer wall 30 of the reservoir 26. The external side 28 of the outer wall 30 of the reservoir 26 is curve so the reservoir 26 has an ovoid shape. The top side 32 of the outer wall 30 of the reservoir 26 is coupled to a bottom side 36 of the outer wall 18 of the handle 12. The reservoir 26 contains a fluid 38. Finally, the fluid 38 may be water.

A fill spout 40 is coupled to and extends upwardly from the top side 32 of the outer wall 30 of the reservoir 26. The fill spout 40 is in fluid communication with an interior of the reservoir 26. Additionally, the fill spout 40 is positioned proximate a back side 42 of the reservoir 26. A cap 44 is removably coupled to an open top end 46 of the fill spout 40. Lastly, the fluid 38 is poured through the open top end 46 of the fill spout 40 to fill the reservoir 26.

A pump 48 is coupled to an inside surface 50 of the outer wall 18 of the handle 12. The pump 48 may be a fluid pump of any conventional design. The shaft 22 of the umbrella 24 has a fluid aperture 52 extending through an outer wall 54 of the shaft 22 of the umbrella 24. The fluid aperture 52 is positioned proximate a top end 56 of the shaft 22 of the umbrella 24. The umbrella 24 may be an umbrella 24 of any conventional design.

The fluid aperture 52 is one of a plurality of the fluid apertures 58. The plurality of fluid apertures 58 is evenly spaced apart and distributed around an entire circumference of the shaft 22 of the umbrella 24. Moreover, the plurality of fluid apertures 58 comprises a pair of sets of the plurality of fluid apertures 60. A top one of the pair of sets of the plurality of fluid apertures 62 is positioned between a plurality of ribs 64 of the umbrella 24 and a plurality of stretchers 66 of the umbrella 24. Moreover, a bottom one of the pair of sets of the plurality of fluid apertures 68 is positioned between a runner 70 of the umbrella 24 and the plurality of stretchers 66 of the umbrella 24.

An actuator 72 is coupled to the handle 12. The actuator 72 is electrically coupled to the pump 48. Additionally, the actuator 72 selectively actuates the pump 48.

A tube 74 is coupled to the umbrella 24. The tube 74 is one of a pair of the tubes 76. An intake one of the pair of tubes 78 is fluidly coupled to a bottom 80 of the pump 48. The intake tube 78 extends downwardly into the reservoir 26. A free end 82 of the intake tube 78 is positioned in the fluid 38. The pump 48 urges the fluid 38 upwardly through the intake tube 78.

An outlet one of the pair of tubes 84 is fluidly coupled to a top 86 of the pump 48. The outlet tube 84 extends upwardly through an interior of the shaft 22 of the umbrella 24. The outlet tube 84 is fluidly coupled to the plurality of fluid apertures 58. Additionally, the fluid 38 is sprayed outwardly from the shaft 22 of the umbrella 24.

A power supply 88 is coupled to the handle 12. The power supply 88 is electrically coupled to the actuator 72. Additionally, the power supply 88 comprises at least one battery 90. The power supply 88 may have an operational voltage between 6 VDC and 9 VDC.

In use, the umbrella 24 is positioned in a deployed position to create shade for the user. The user actuates the actuator 72 so the pump 48 urges the fluid 38 upwardly through the outlet tube 84 and outwardly through the plurality of fluid apertures 58. The fluid 38 is sprayed downwardly onto the user so the user is cooled. Finally, the reservoir 26 is re-filled when the fluid 38 is depleted.

With respect to the above description, it is to be realized that the optimum dimensional relationship for the various components of the fluid misting assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the fluid misting assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A fluid misting assembly coupled to an umbrella, said assembly comprising:

a handle coupled to the umbrella such that the handle is configured to be gripped by a user;

a reservoir coupled to said handle, said reservoir containing a fluid;

a pump coupled to said handle, said pump being operationally coupled to said reservoir such that said pump urges the fluid outwardly from said reservoir;

a shaft of the umbrella having a plurality of fluid apertures extending there through;

a tube coupled to the umbrella, said tube being operationally coupled to said pump such that said pump urges the fluid through said tube, said tube being operationally coupled to said fluid apertures extending through the shaft of the umbrella such that the fluid is sprayed outwardly from the shaft onto the user;

wherein a top wall of said reservoir being coupled to a bottom side of an outer wall of said handle;

wherein said plurality of said fluid apertures being evenly spaced apart and distributed around an entire circumference of the shaft of the umbrella;

said plurality of fluid apertures comprising a pair of sets of said plurality of fluid apertures;

a bottom one of said pair of sets of said plurality of fluid apertures being spaced away from a top one of said pair of sets of said plurality of fluid apertures.

2. The assembly according to claim 1, wherein said handle having a first end and a second end, said first end of said handle being open, said handle being substantially hollow.

3. The assembly according to claim 1, wherein said outer wall of said handle being curved between a first end and a second end of said handle such that said handle has a J-shape.

4. The assembly according to claim 1, wherein a first end of said handle insertably receiving a bottom end of the shaft of the umbrella.

5. The assembly according to claim 1, wherein said pump being coupled to an inside surface of said outer wall of said handle.

6. The assembly according to claim 1, wherein said fluid apertures extending through an outer wall of the shaft of the umbrella such that said fluid apertures are positioned proximate a top end of the shaft of the umbrella.

7. The assembly according to claim 1, wherein said tube is a pair of tubes.

8. The assembly according to claim 7, wherein an intake one of said pair of tubes being fluidly coupled to a bottom of said pump such that said intake tube extends downwardly into said reservoir, said pump urging the fluid upwardly through said intake tube.

9. The assembly according to claim 7, wherein an outlet one of said pair of tubes being fluidly coupled to a top of said pump.

10. The assembly according to claim 9, wherein said outlet tube extending upwardly through an interior of the shaft of the umbrella such that said outlet tube is fluidly coupled to said plurality of fluid apertures.

11. The assembly according to claim 1, wherein a power supply coupled to said handle.

12. The assembly according to claim 11, wherein:

said power supply being electrically coupled to said pump; and said power supply comprising at least one battery.

13. A fluid misting assembly coupled to an umbrella, said assembly comprising:

a handle coupled to the umbrella such that the handle is configured to be gripped by a user;

a reservoir coupled to said handle, said reservoir containing a fluid;

a pump coupled to said handle, said pump being operationally coupled to said reservoir such that said pump urges the fluid outwardly from said reservoir;

a shaft of the umbrella having a fluid aperture extending therethrough;

a tube coupled to the umbrella, said tube being operationally coupled to said pump such that said pump urges the fluid through said tube, said tube being operationally coupled to said fluid aperture extending through the shaft of the umbrella such that the fluid is sprayed outwardly from the shaft onto the user;

wherein a top wall of said reservoir being coupled to a bottom side of an outer wall of said handle; said pump being coupled to an inside surface of said outer wall of said handle; said fluid aperture extending through an outer wall of the shaft of the umbrella such that said fluid aperture is positioned proximate a top end of the shaft of the umbrella.

14. The assembly according to claim 13, wherein said handle having a first end and a second end, said first end of said handle being open; said handle being substantially hollow; said outer wall of said handle being curved between said first end and said second end of said handle such that said handle has a J-shape; said first end of said handle insertably receiving a bottom end of the shaft of the umbrella.

15. The assembly according to claim 13, wherein said fluid aperture being one of a plurality of said fluid apertures being evenly spaced apart and distributed around an entire circumference of the shaft of the umbrella; said plurality of fluid apertures comprising a pair of sets of said plurality of fluid apertures; a bottom one of said pair of sets of said plurality of fluid apertures being spaced away from a top one of said pair of sets of said plurality of fluid apertures.

16. The assembly according to claim 13, wherein said tube being one of a pair of said tubes; an intake one of said pair of tubes being fluidly coupled to a bottom of said pump such that said intake tube extends downwardly into said reservoir, said pump urging the fluid upwardly through said intake tube; an outlet one of said pair of tubes being fluidly coupled to a top of said pump; said outlet tube extending upwardly through an interior of the shaft of the umbrella such that said outlet tube is fluidly coupled to a plurality of said fluid apertures; a power supply coupled to said handle; said power supply being electrically coupled to said pump; said power supply comprising at least one battery.

* * * * *